US007918336B2

(12) United States Patent
Olsen et al.

(10) Patent No.: US 7,918,336 B2
(45) Date of Patent: Apr. 5, 2011

(54) CLOSURE DEVICE WITH CORRUGATED RING PLUNGER PART

(75) Inventors: Geir L. Olsen, Glomfjord (NO); Frode Busterud, Bodø (NO)

(73) Assignee: TasteIN Technology AS, Bodo (NO)

( * ) Notice: Subject to any disclaimer, the term of this patent is extended or adjusted under 35 U.S.C. 154(b) by 1125 days.

(21) Appl. No.: 11/590,867

(22) Filed: Nov. 1, 2006

(65) Prior Publication Data

US 2007/0102394 A1 May 10, 2007

Related U.S. Application Data

(60) Provisional application No. 60/732,141, filed on Nov. 2, 2005.

(51) Int. Cl.
*B65D 25/08* (2006.01)
*B67D 7/78* (2010.01)

(52) U.S. Cl. ..... 206/221; 222/129; 222/145.1

(58) Field of Classification Search ..... 206/219, 206/221, 222; 222/82–83, 129, 137, 145.1, 222/145.6

See application file for complete search history.

(56) References Cited

U.S. PATENT DOCUMENTS

| | | | | |
|---|---|---|---|---|
| 2,631,521 | A | 3/1953 | Atkins, Jr. | |
| 4,221,291 | A | 9/1980 | Hunt | |
| 5,217,433 | A | 6/1993 | Bunin | |
| 5,431,276 | A | 7/1995 | Lialin | |
| 5,529,179 | A | 6/1996 | Hanson | |
| 5,979,647 | A | 11/1999 | Han | |
| 6,352,177 | B1 * | 3/2002 | Bublewitz et al. | 222/82 |
| 6,609,612 | B2 | 8/2003 | Vlodek | |
| 6,959,841 | B2 | 11/2005 | Voldek | |
| 2002/0050461 | A1 | 5/2002 | Vlodek | |
| 2004/0007481 | A1 | 1/2004 | Kiser | |

FOREIGN PATENT DOCUMENTS

| | | | |
|---|---|---|---|
| FR | 2 569 666 | A1 | 3/1986 |
| JP | 03 098871 | A | 4/1991 |
| WO | WO 2004/024587 | A2 | 3/2004 |
| WO | WO 2004/103853 | A | 12/2004 |

* cited by examiner

*Primary Examiner* — Bryon P Gehman

(74) *Attorney, Agent, or Firm* — Finnegan, Henderson, Farabow, Garrett & Dunner, L.L.P.

(57) ABSTRACT

A closure device with or without a drinking mechanism for bottles or receptacles, arranged to be attached to the bottle or receptacle. The device has a first cavity preferably for an additive and at least one second cavity where the first and the at least one second cavity can be opened individually by opening mechanisms which are integrated in the device and can be operated from outside of the device.

9 Claims, 22 Drawing Sheets

Fig 1
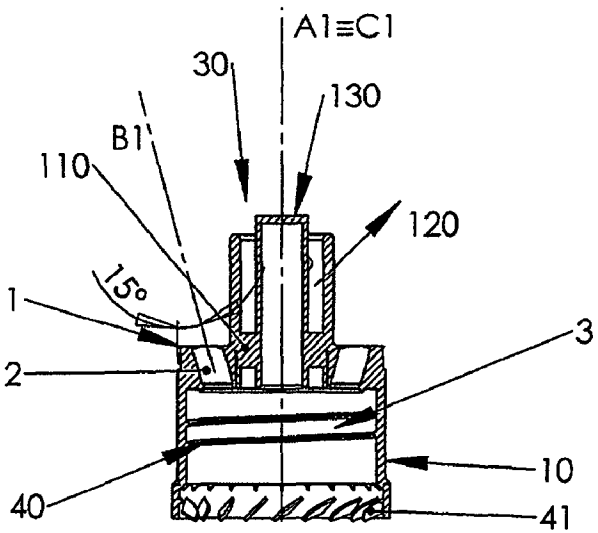
Fig 1B
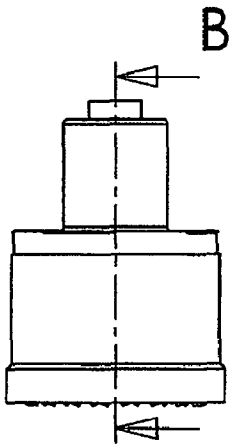
Fig 1A

Fig. 2
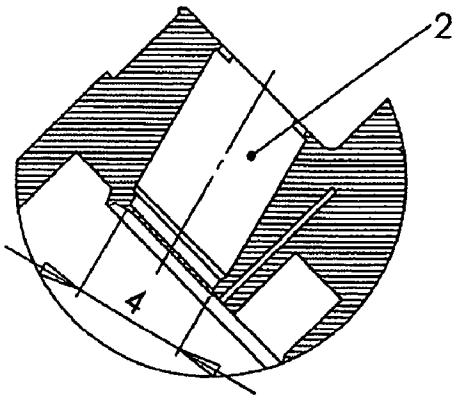
Fig. 2C
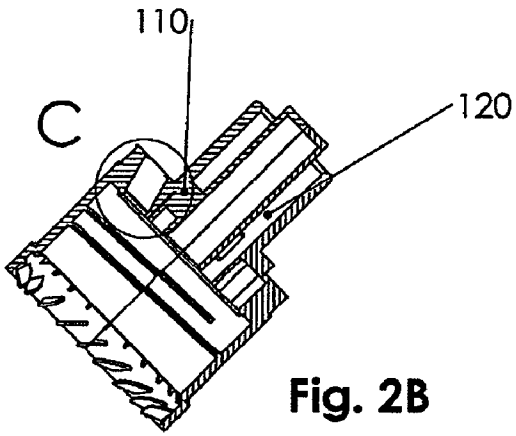
Fig. 2B
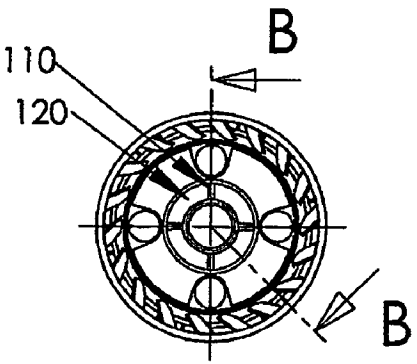
Fig. 2A

Fig.9
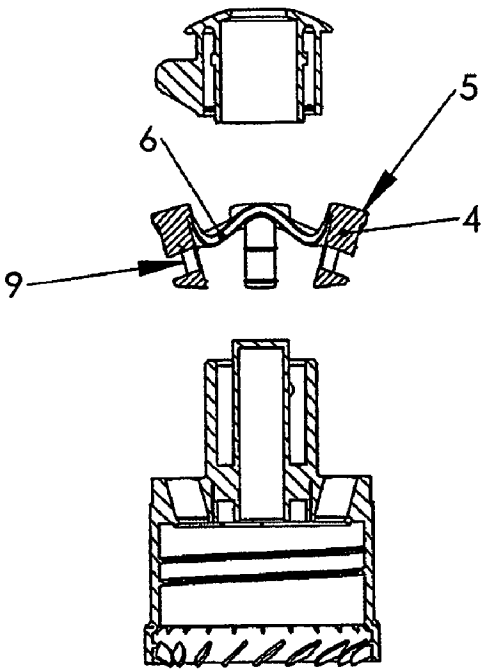
Fig.9B
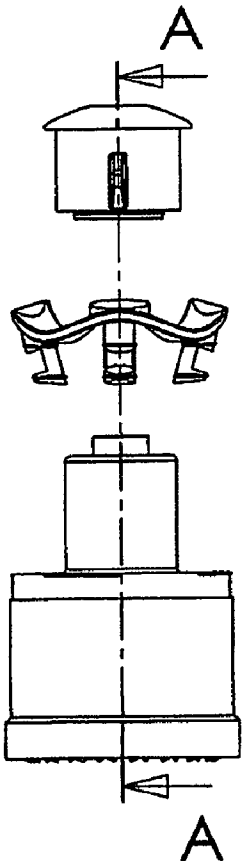
Fig.9A

Fig.10
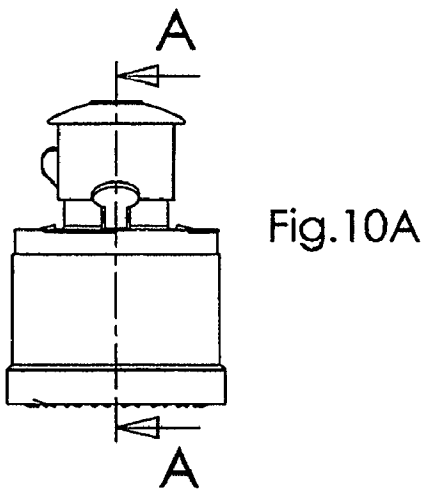
Fig.10A
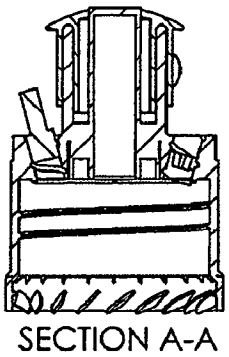
Fig.10C
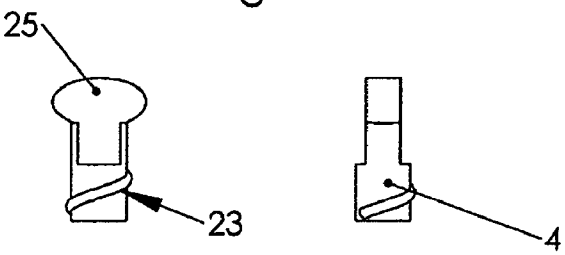
Fig.10D
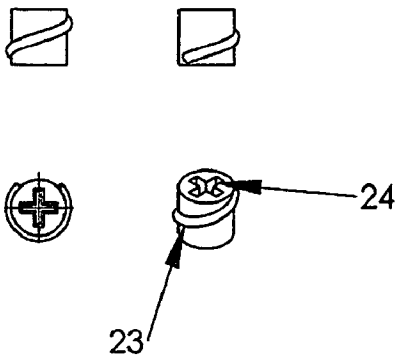
Fig.10B Fig 11
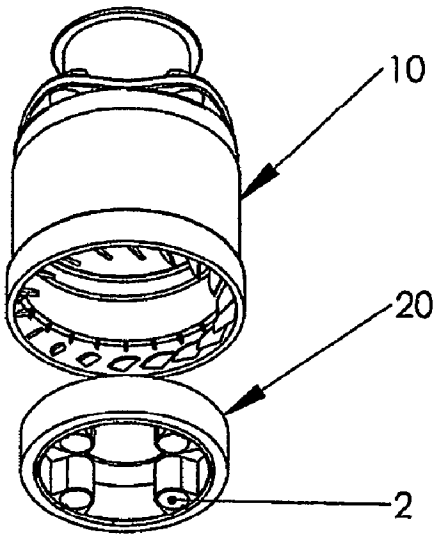
Fig 11B
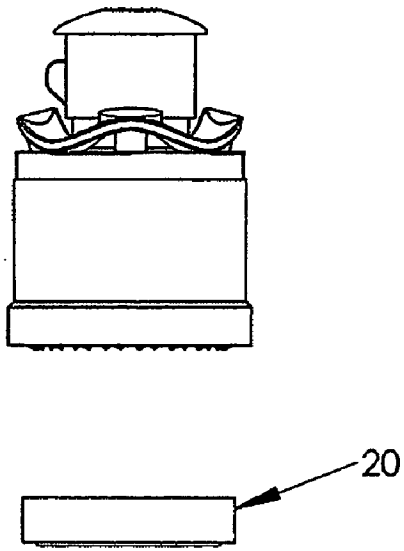
Fig 11A Fig.13
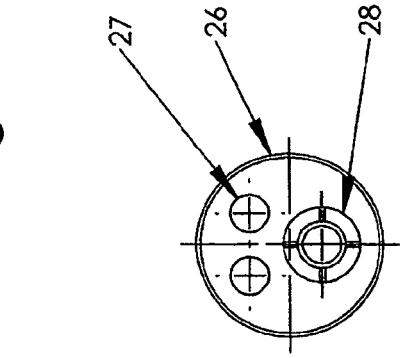
Fig 13D
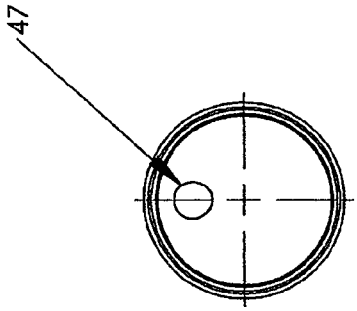
Fig 13C
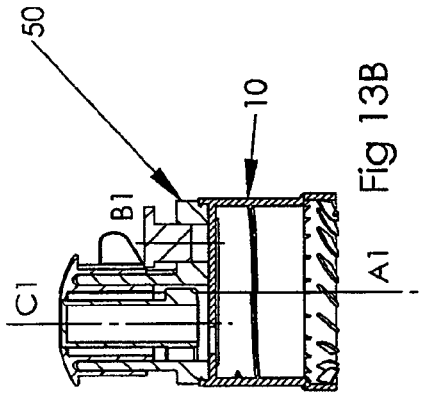
Fig 13B
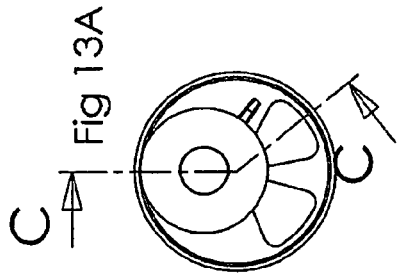
Fig 13A
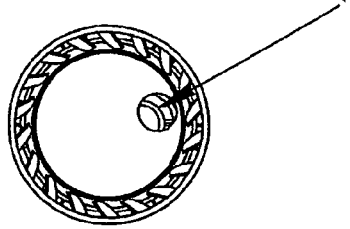
Fig 13E Fig.16
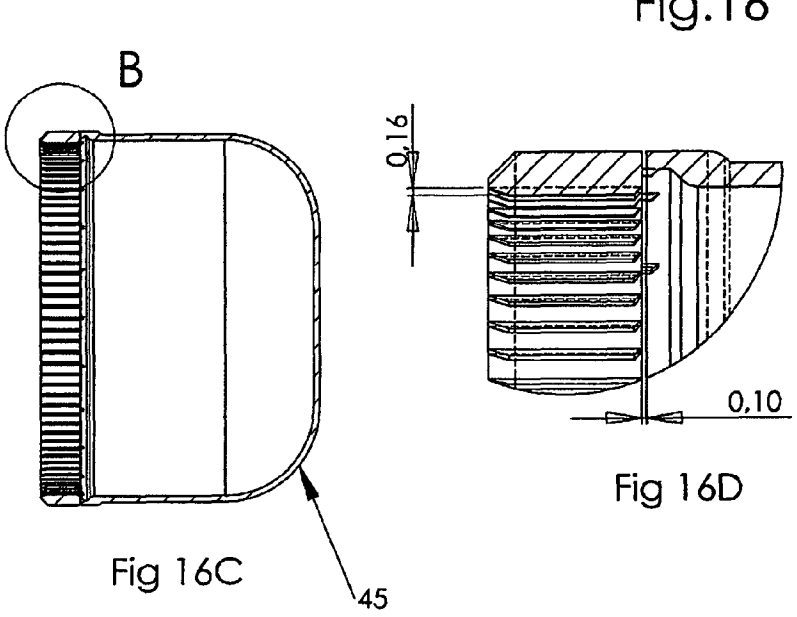
Fig 16D
Fig 16C
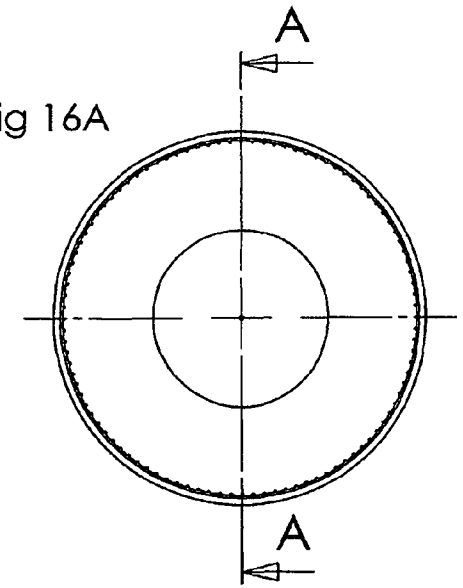
Fig 16A
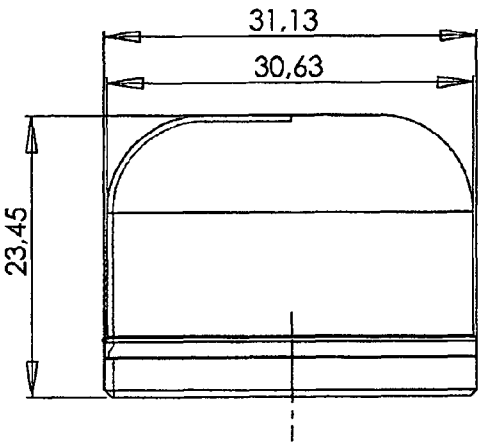
Fig 16B 105
10

F
C

B
B
102
104
31
100
106

103
G
G

H
H
130
32

10
106

Fig 19
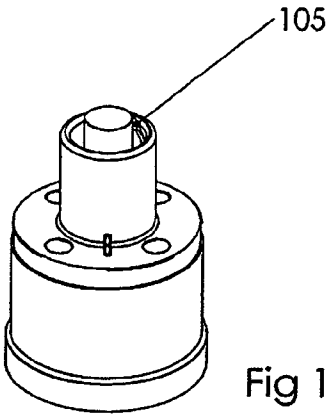
Fig 19D
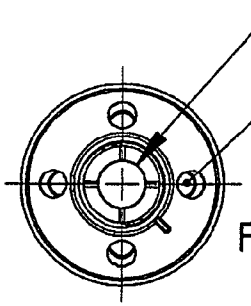
Fig 19A
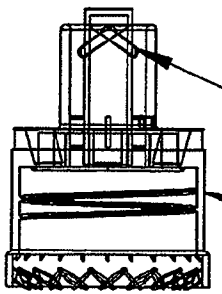
Fig 19B
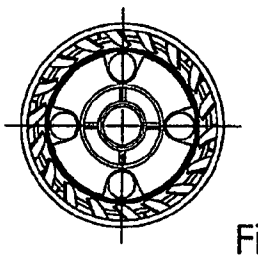
Fig 19C

CLOSURE DEVICE WITH CORRUGATED RING PLUNGER PART

CROSS REFERENCE TO RELATED APPLICATIONS

This application claims the benefit of U.S. Provisional Application No. 60/732,141, filed Nov. 2, 2005, the content of which is incorporated herein by reference.

BACKGROUND OF THE INVENTION

The present invention relates to a closure device for bottles/receptacles arranged to be attached to the bottle/receptacle, and where the device comprises a first cavity, preferably for additive.

Closure devices of the above-mentioned type are previously known, for example from U.S. Pat. No. 2,631,521 which describes a closure for a bottle. The closure has an elastic top which is mechanically connected to a needle. The elastic top is convexly curved, and when depressed it causes the needle to pierce a protective membrane, thereby permitting an additive (in this case a flavour additive) to come into contact with the liquid in the bottle. The closure has to be removed in order to gain access to the contents of the bottle, while at the same time the closure permits a single flavour additive to be dispensed.

U.S. Pat. No. 4,221,291 discloses a closure comprising a bottom part connected to a top part by a rod projecting downwards towards the bottom part. When the top part is depressed, the rod is pushed inwards and the bottom part is partly detached, permitting an additive to be mixed with liquid in the bottle. In order to gain access to the contents of the bottle, the top part has to be removed and a straw inserted in the closure. In this case too the closure does not permit more than a single flavour additive to be dispensed.

U.S. Pat. No. 5,217,433 discloses a closure for medicinal additive. It comprises a first part with the additive, where the part can be pushed in for dispensing the additive into a bottle, whereupon access can be gained to the additive through the first part. This closure does not permit access to the contents of the bottle without dispensing the additive, nor does it permit several different substances to be added.

The object of the invention is to redress the above-mentioned and other drawbacks of the prior art.

One object of the invention is to provide a closure device for a bottle or a receptacle, which closure device permits several additives to be dispensed into the contents of the bottle or receptacle.

Another object of the invention is to provide a closure device which permits the independent dispensing of different additives into the contents of the bottle/receptacle.

Another object of the invention is to provide a closure device which permits access to the contents of the bottle or receptacle without prior dispensing of additives into the contents.

SUMMARY OF THE INVENTION

These and other objects are achieved by means of a closure device according to the invention, which is characterised by providing in the device at least one second cavity, where the first and the second cavities can be opened individually by means of opening mechanisms, which are integrated in the device and can be influenced from the outside of the device.

The closure device according to the invention therefore comprises at least two cavities, where one cavity is intended for a first additive and the second cavity can either be used for a second additive which is similar to the first or different from the first, or for access to the liquid inside the bottle/receptacle.

Amongst other things, the invention permits easy production, distribution and storage of one type of product, which is capable of satisfying different needs among the consumers.

For example, the invention may be employed for adding flavouring to a drink, with the ability either to choose between different additives (where the closure device comprises different additives) and/or to choose the concentration of additive in the drink (where the closure device comprises several cavities with similar additives).

In an embodiment of the invention the closure device is equipped with a drinking mechanism, which is preferably connected to the second cavity. Since the cavities are opened independently of each other, it is possible to provide a closure mechanism that gives access to the contents of the bottle without necessarily having to dispense the additive.

In the present description, the closure device will comprise capsules, corks, crown corks, screw corks, etc. Thus the closure device according to the invention will be able to be connected to the bottle by means of screw threads on the inside or on the outside of the cork, by clamping round the neck of the bottle, by insertion in the neck of the bottle and clamping effect, etc.

The closure device may be integrated in the bottle/receptacle or it may be supplied as a separate part.

The invention also comprises a variant, where a drinking mechanism is provided in a closable manner by turning a rotating part.

BRIEF DESCRIPTION OF THE DRAWINGS

The invention will now be described by means of several examples which are only illustrative and in no way limiting. The examples are illustrated in the drawings, in which:

FIGS. 1, 2 and 3 illustrate a first embodiment of the invention.

FIG. 9 illustrates a second variant of the plungers.

FIG. 10 illustrates a further variant of the plungers.

FIG. 11 illustrates a fourth embodiment of the invention.

FIG. 13 illustrates a sixth embodiment of the invention.

FIG. 16 illustrates a cap.

FIGS. 18-20 illustrate a part of the drinking mechanism.

DETAILED DESCRIPTION OF THE INVENTION

Figure 3A:
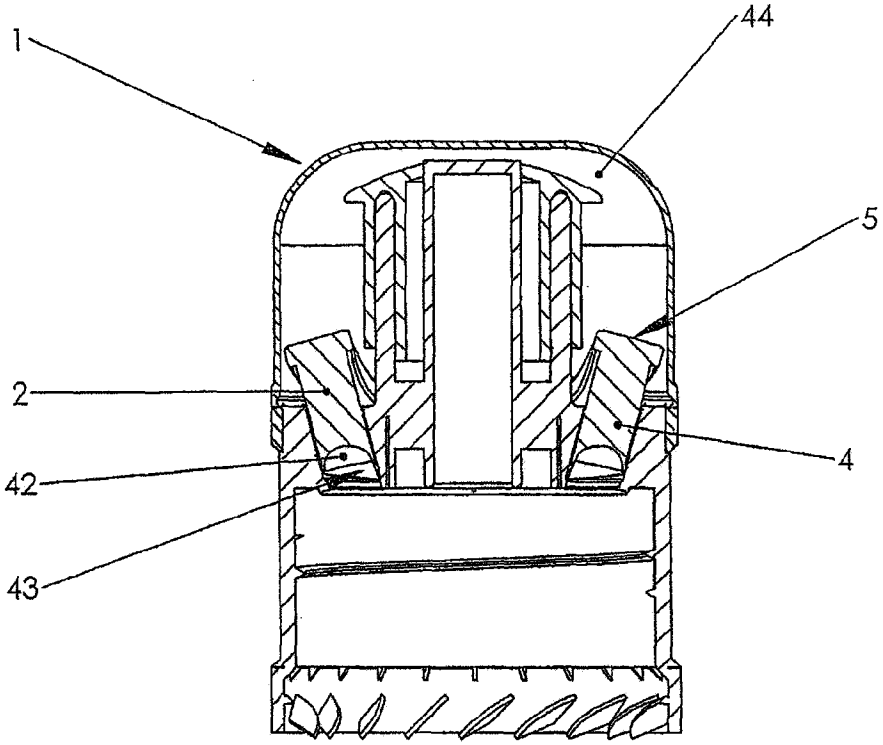

FIGS. 1 and 2 illustrate a part of the closure device according to the invention. The closure device 1 comprises a closure body 10 with a drinking mechanism 30. The closure body is further equipped with threads 40 for attachment to a bottle or receptacle (not shown) and with a seal 41 to ensure against tampering. The closure body comprises a first cavity 2 for additive and a second cavity 120 which in this embodiment is intended for access to the beverage. The first and the second cavities 2 and 120 respectively can be opened individually (as shown in FIG. 2) by means of opening mechanisms which are integrated in the closure device and can be influenced from the outside of the device.

The closure body comprises a third cavity 3 which can be connected with the first and the second cavities 2 and 120 respectively.

FIG. 1 also illustrates different axes that can be defined for the closure device and the cavities. As mentioned earlier, in this embodiment of the invention the closure device comprises a cylindrical closure body 10 arranged to be affixed to the bottle/receptacle and with an axis of rotation A1. The first cavity 2 is elongated along a first axis B1 and the second cavity 120 is elongated along a second axis C1.

As can be seen in the figure, the axis B1 of the first cavity 2 is not parallel to the axis A1 of the closure body 10 while the axis C1 of the second cavity 120 coincides with the axis A1 of the closure body 10. The figures illustrate that the drinking mechanism 30 in this embodiment of the invention comprises a central part 130 for insertion in a central opening in a rotatable part 31. The interaction of the rotatable part 31 and the central part 130 will be explained in more detail later. Even though it is not shown in the figure, it is possible to implement a closure body according to the invention where the axis B1 is parallel to the axis C1.

The drinking mechanism 30 further comprises wall parts 110 defining elongated cavities 120 both from the side and from below. As shown in FIG. 2A the cavities 120 are connected with the cavity 3, thus enabling the drink to flow out therethrough.

FIG. 3 illustrates an embodiment of the invention where the opening mechanism comprises a plunger part 5 with several plungers 4, where each of the plungers can be influenced individually. As can be seen, in this special embodiment of the invention the bottom 42 of the plungers 4 is concavely curved. The edge of the bottom is sharp with the result that when the plunger 4 is depressed, a cap 43 covering the bottom of the cavities 2 is completely or partly removed, enabling the additive to be freely mixed with the contents of the bottle.

In this embodiment of the invention the cavity 120 is not intended for additive, but for use in the drinking mechanism, the latter comprising a drinking spout 44. FIG. 3B illustrates the device equipped with a cover 45.

Figure 3B:
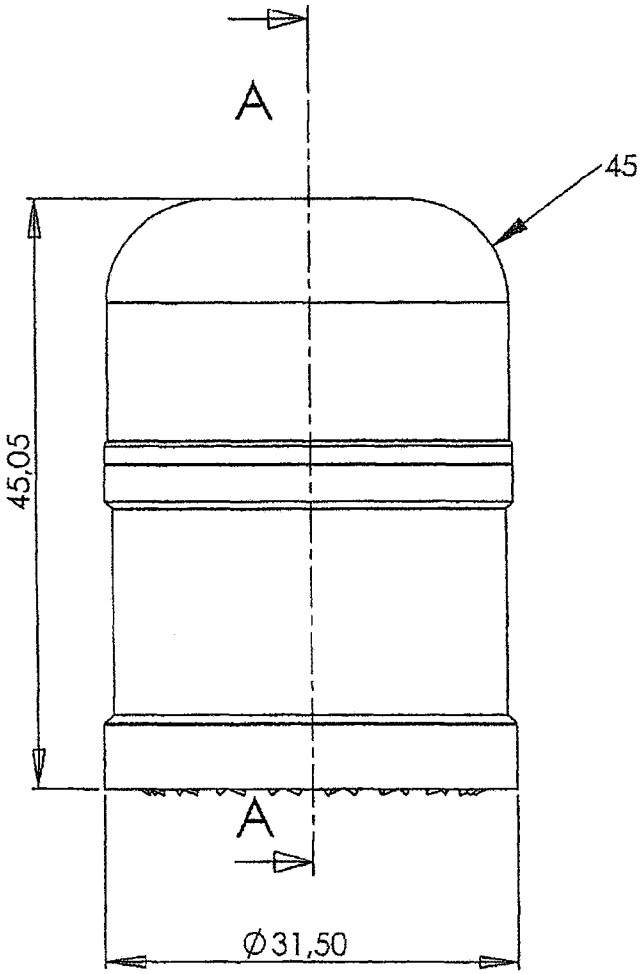
Figure 3E:
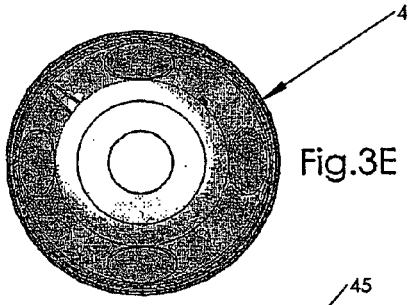
Figure 3C:
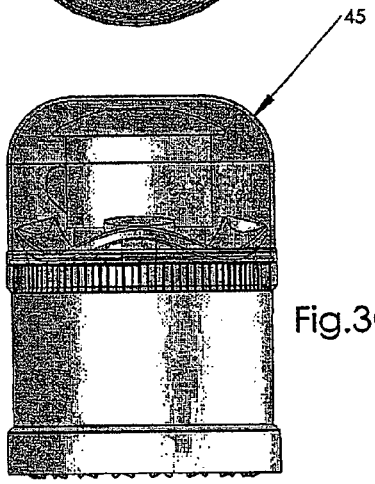
Figure 3D:
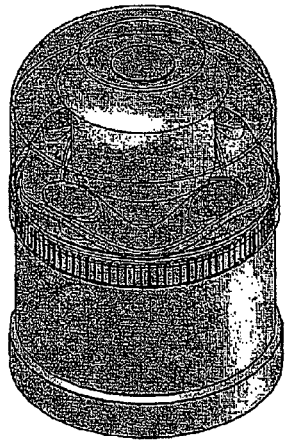
Figure 3F:
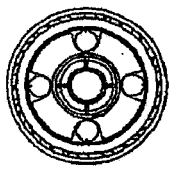
Figure 3G:
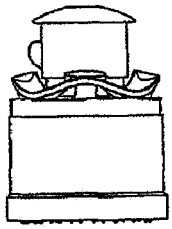
Figure 3H:
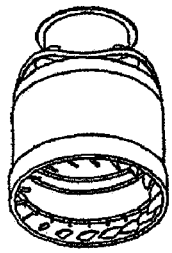
Figure 3I:
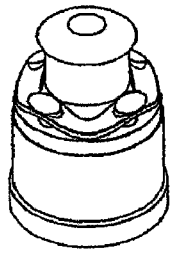

FIGS. 3C and 3D illustrate the same embodiment as FIG. 3A but provided with a transparent cover 45. FIG. 3E is a view of the invention from above, and this figure illustrates the oval shape of the upper part of the plungers 4.

FIGS. 3F-3I illustrate a variant of the same embodiment, where the closure device is made of a transparent plastic material, thereby enabling the user to see which additive is used.

Figure 4A:
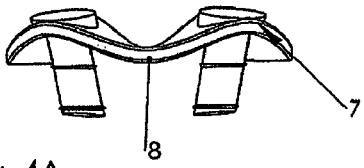
FIG. 4 illustrates a detail of the plunger part in the embodiment in FIG. 3.
Figure 4B:
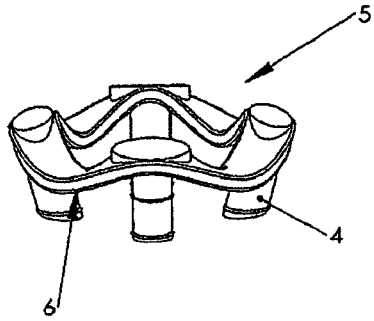
Figure 4C:
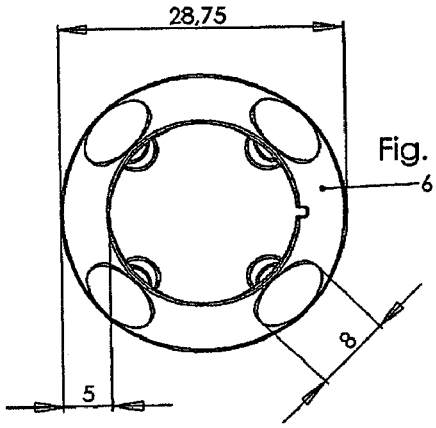

FIG. 4 depicts a detail of the plunger part 5 in the embodiment in FIG. 3. In this embodiment of the invention plunger part 5 comprises a ring 6, and the plungers 4 project downwards from the ring 6 into the additive cavity/cavities 2 (FIG. 3). In this embodiment of the invention the ring 6 is corrugated with raised portions 7 and depressions 8, and the plunger/plungers 4 project downwards from the raised portions 7. In a preferred embodiment the plungers 4 are integrated in the ring 6. In this figure the plungers are arranged slantingly relative to the closure body's axis, but it is possible to implement a variant where the plungers are vertical, i.e. with an axis which is parallel to the closure body.

Figure 5:
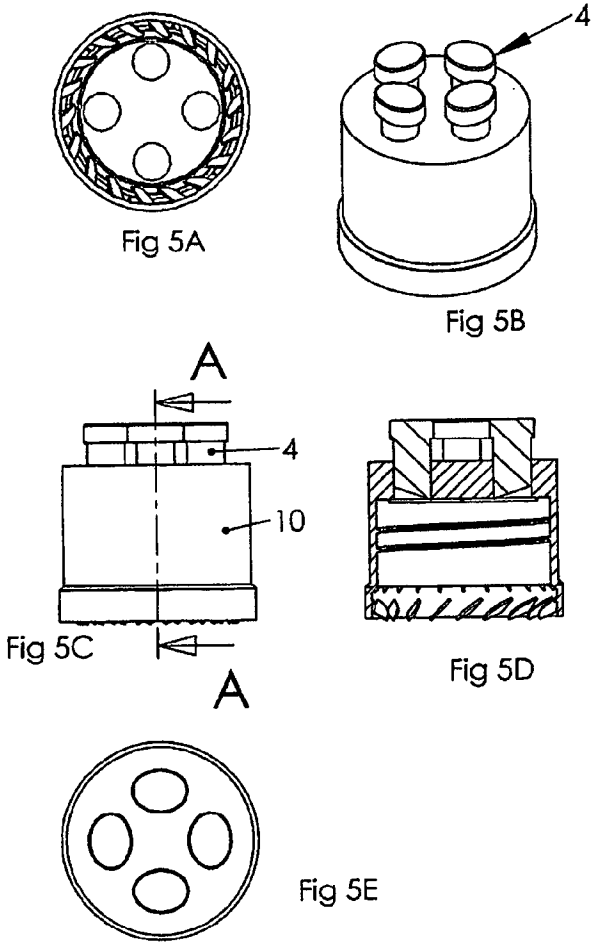
FIG. 5 illustrates a second embodiment of the invention.

FIG. 5 illustrates a second embodiment of the invention, FIG. 5A is a view of the closure body from below, 5B is a view from above, 5C is a view from the side, 5D is a section and 5E is a view from above. In this embodiment the closure device 1 does not contain any drinking mechanism, and both the first and the second cavities are intended for additive. In this embodiment of the invention the opening mechanism comprises plungers 4 which can be influenced from the outside of the device. In this embodiment of the invention the plungers comprise an upper part which is oval and a lower part with a circular cross section. It is also possible to make plungers with an oval cross section along the entire length of the plungers. In this embodiment the closure device has to be removed in its entirety in order to gain access to the beverage inside the bottle.

Figure 6:
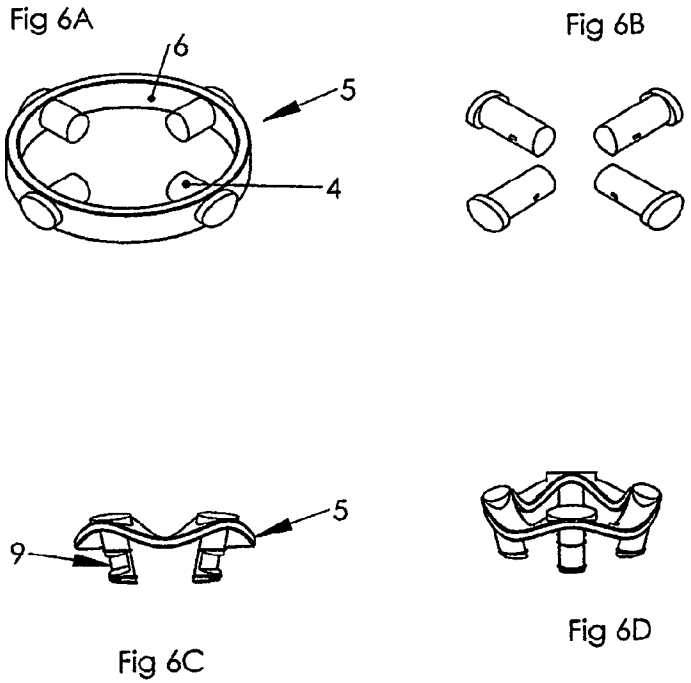
FIG. 6 illustrates a variant of the plungers.

FIG. 6 illustrates variants of the closure mechanism for use, for example, in the embodiment according to FIG. 5. FIGS. 6A and 6B illustrate a variant where the plungers 4 are free-standing and can be passed through apertures in the ring part 6. FIGS. 6C and 6D illustrate an embodiment where the plungers are integrated with the ring 6; in FIG. 6C the plungers comprise cavities 9 for additive. All other variants of the closure mechanism mentioned in this description will be able to be used in this variant of the invention.

FIG. 7 illustrates a third embodiment of the invention. In this embodiment the axes B1 of the cavities 2 are at right angles to the axis A1 of the main body. In addition, cavity 2 is arranged for connection to the third cavity 3. Plunger part 5 is composed of a ring 6 and the plungers 4 project inwards from the ring 6, where the ring 5 may be flexible and the plungers may also be free. While in the embodiment in FIGS. 7A-7C the plungers 4 are still operated independently of each other, the plungers 4 in FIGS. 7D-7F are arranged in such a manner that the first plunger that is depressed will project into the common space and substantially lock the other plungers in the outer position. The opening mechanism is therefore arranged to prevent opening of an additive cavity when another additive cavity is opened.

Most of the embodiments of the invention require the ring 6 to be made of a flexible and/or elastic material, with the result that the plungers return to the initial position due to the elasticity of the material. The material is also important for ensuring the necessary individual movement of the plungers 4.

Figure 7B:
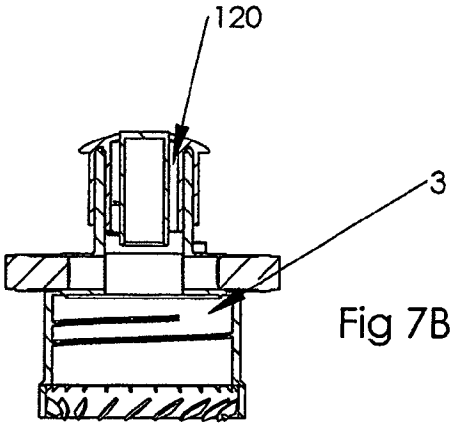
FIG. 7 illustrates a third embodiment of the invention.
Figure 7A:
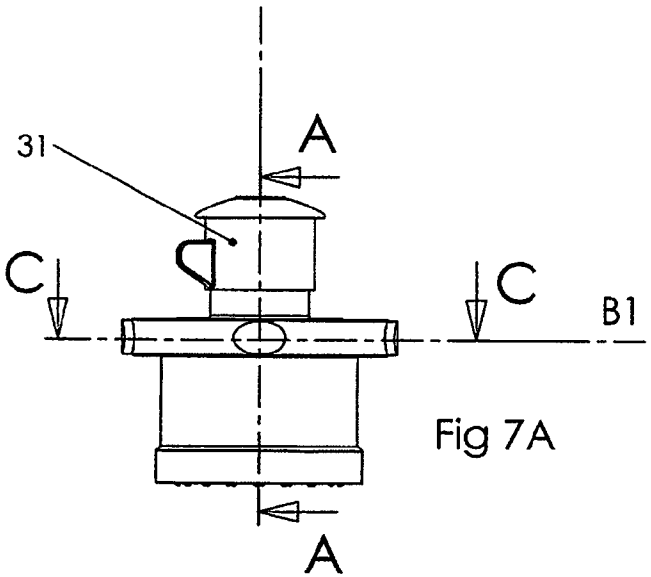
Figure 7C:
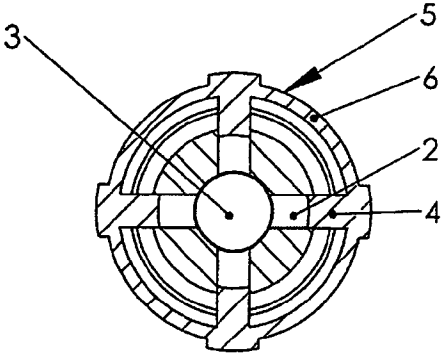
Figure 7D:
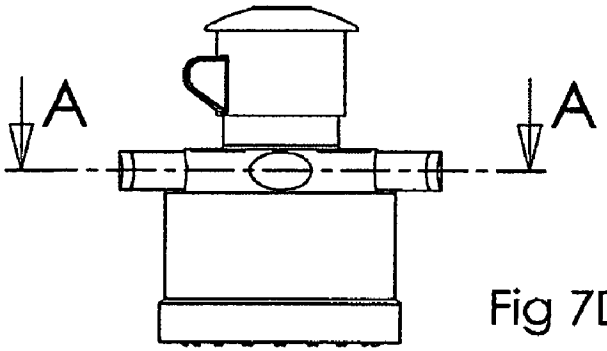
Figure 7E:
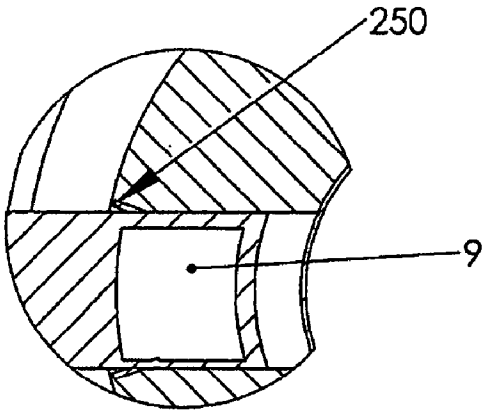
Figure 7F:
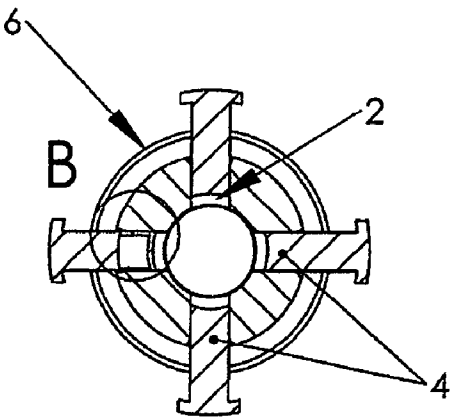

In FIG. 7F the plungers 4 are free-standing, but the plungers 4 may also be integrated in the ring 6. FIG. 7E shows a lobe 250 that locks the plunger 4 in the inner position.

Figures 8, 8A, 8B, 8C:
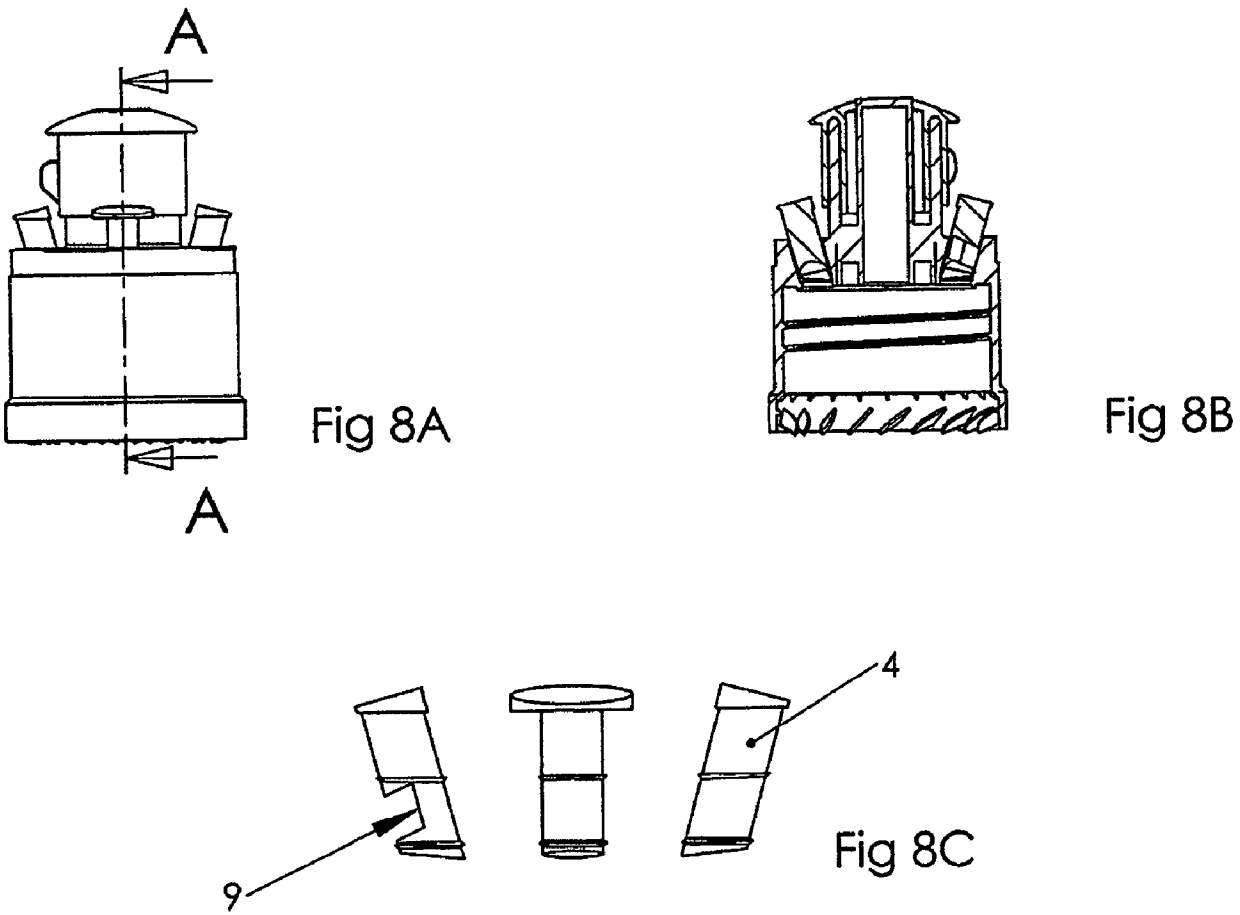
FIG. 8 illustrates a variant of the plungers.

FIGS. 7E and 8 illustrate a variant of the plungers 4, where they are provided with cavities 9 for additive, i.e. they form one of the said first and second cavities 2 and 120 respectively. Cavity 9 is restricted partly by the plunger walls and partly by the cavity walls. As will be obvious to a person skilled in the art, these plungers may be employed in several embodiments of the opening mechanism, i.e. independently of whether the axis of the cavity is parallel or not parallel to the axis of the closure body or whether they are attached to a ring (FIG. 6) or not (FIG. 8).

FIG. 9 illustrates the case where plungers 4 with cavities 9 are integrated in a ring 6.

FIG. 10 illustrates a further variant of the plungers 4. In this variant the plungers 4 comprise a threaded part 23 as illustrated in FIG. 10B. In the same figure the plungers further comprise slots 24 for inserting a screwdriver device (not shown) while in FIG. 10D the plungers comprise wings 25 for causing rotation of the plunger.

FIG. 11 illustrates a fourth embodiment of the invention. The closure device according to this embodiment comprises a storage part 20 with cavity 2 (and possibly 120). This embodiment permits a food company, for example, to supply a ready-filled storage unit that can be attached to the closure body 10 from below. From the production point of view, this embodiment will permit low-cost manufacture of the closure device.

Figures 12, 12A, 12B, 12C, 12D, 12E, 12F:
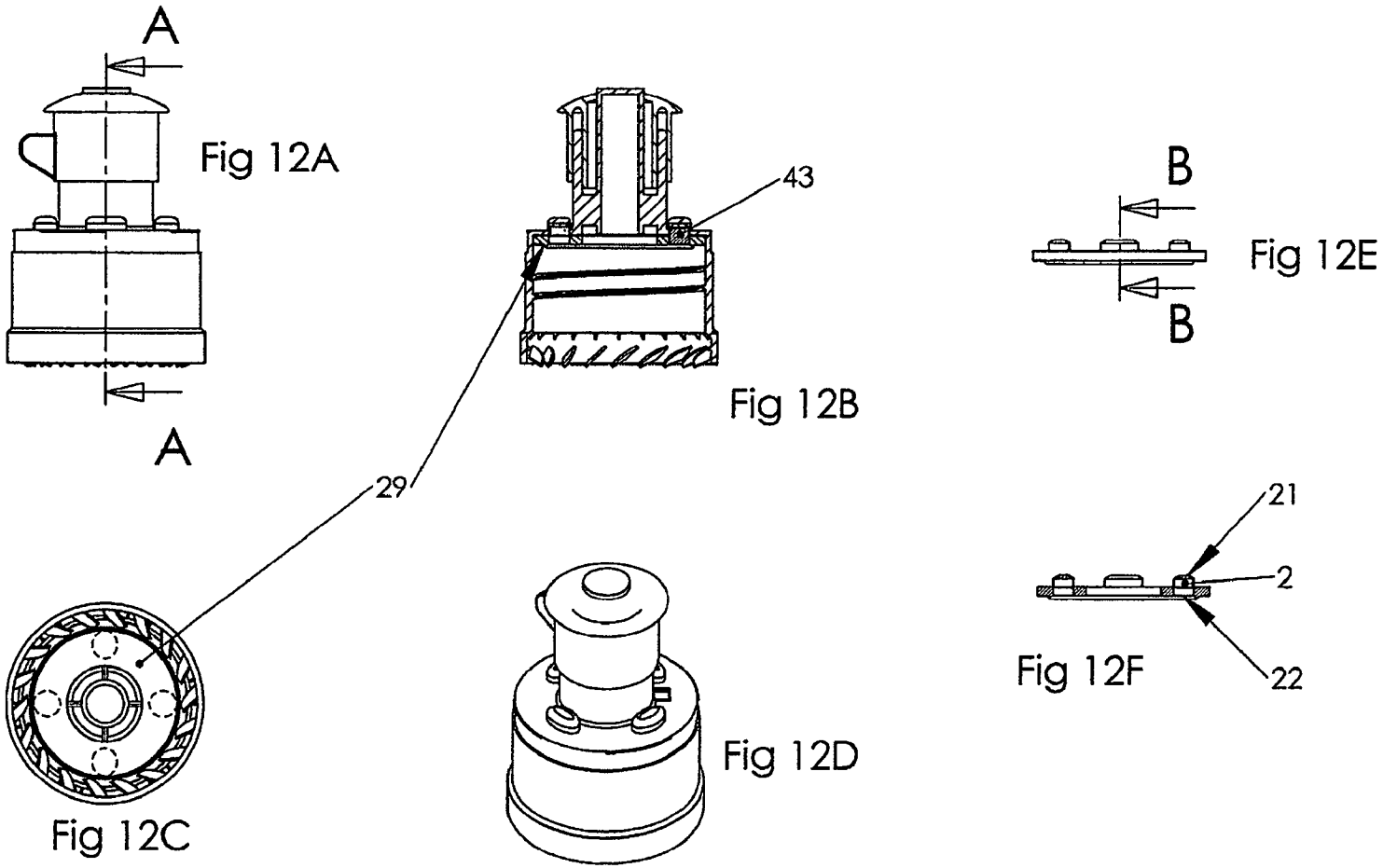
FIG. 12 illustrates a fifth embodiment of the invention.

FIG. 12 illustrates a fifth embodiment of the invention. FIG. 12C is a view of the closure body from below. In this embodiment the cavities 2 are bounded by a capsule 21 and a foil 22. The capsule 21 and the foil 22 thereby constitute the opening mechanism which can be depressed from the outside of the device. To manufacture this embodiment, the additive is placed, for example in the form of tablets from the bottom, whereupon the foil 22 seals the cavities. Capsule 21 is flexible. A tray 20 may also be employed for insertion and it can be broken when depressed. The closure body further comprises a rotatable drinking spout 31 with a control protrusion 100.

FIG. 13 illustrates a sixth embodiment of the invention. FIG. 13A is a view of the closure body from above, FIG. 12B is a section, FIGS. 12C and 12E are views of the closure body from below. FIG. 13D depicts the lower surface of the upper part 1. In this embodiment the axis of rotation A1 for the cylindrical closure body 10 is parallel with the axes of rotation B1 and C1 for the cavities. The closure body 10 is equipped with an aperture 47 in the bottom. A disc 26 with sealed cavities 27 and 28 is mounted under the closure body. An upper part 50 is twisted in order to align the aperture 47 with one of the cavities 27 or 28. This embodiment also comprises a rotatable drinking spout.

Figure 14:
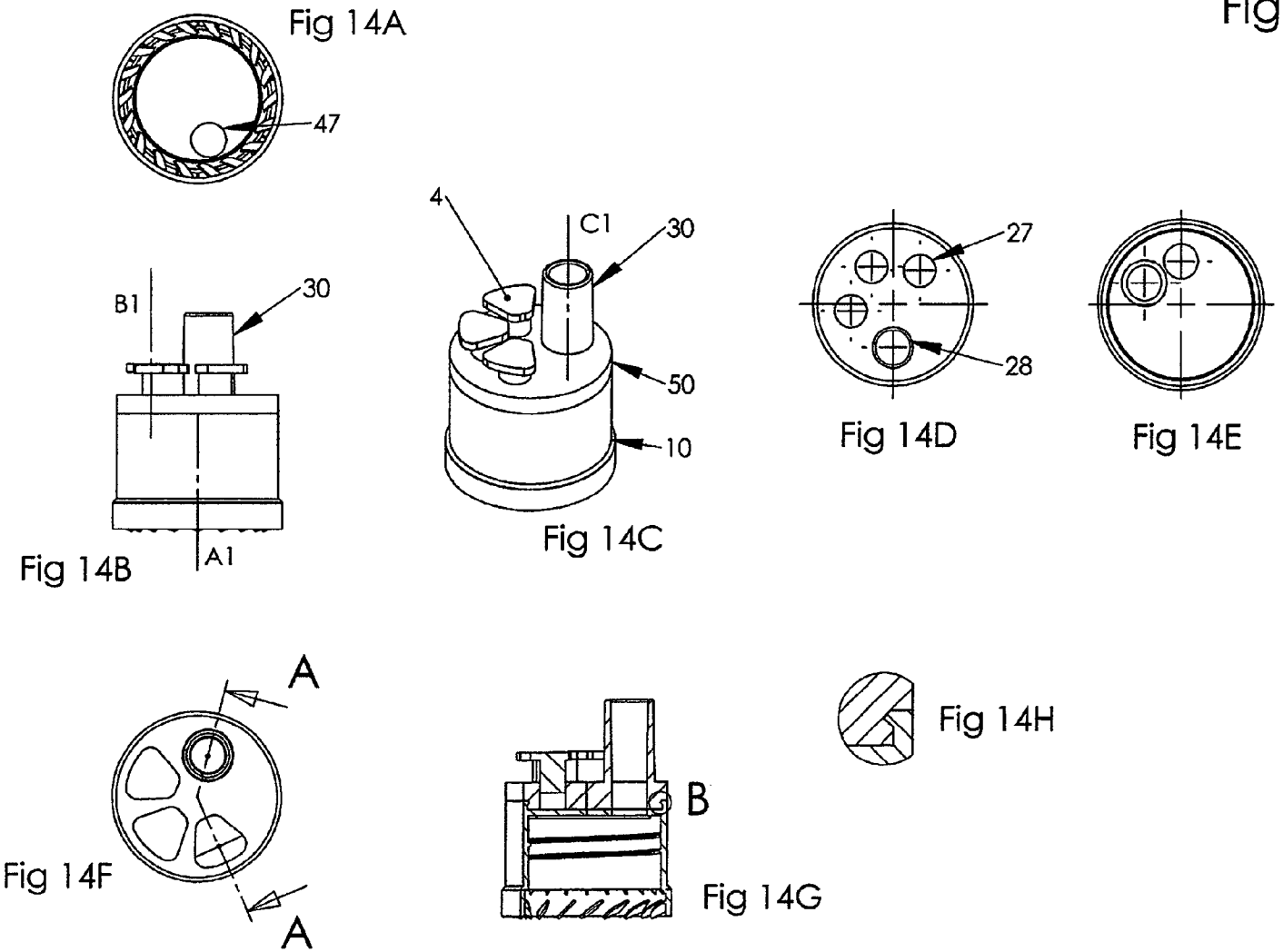
FIG. 14 illustrates a seventh embodiment of the invention.
Figure 15A:
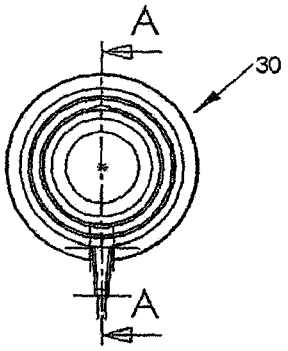
FIG. 15 illustrates a drinking spout.
Figure 15B:
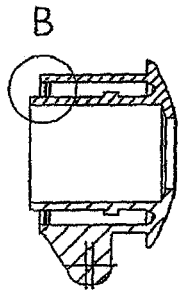
Figure 15F:
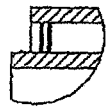
Figure 15C:
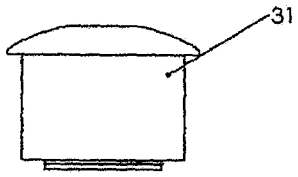
Figure 15E:
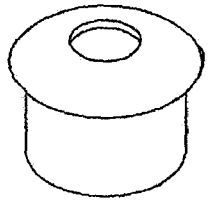
Figure 15D:
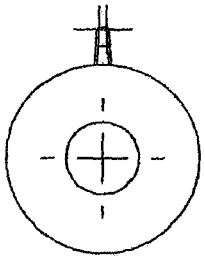
Figure 17A:
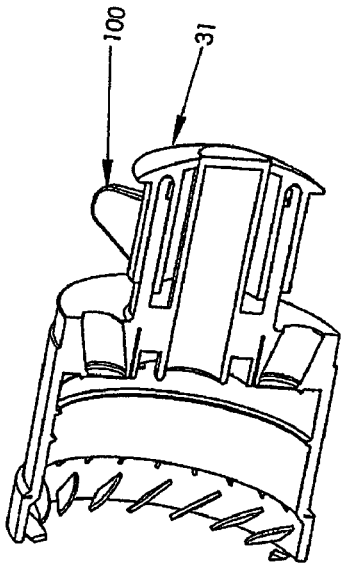
FIG. 17 illustrates an eighth embodiment of the invention.
Figure 17B:
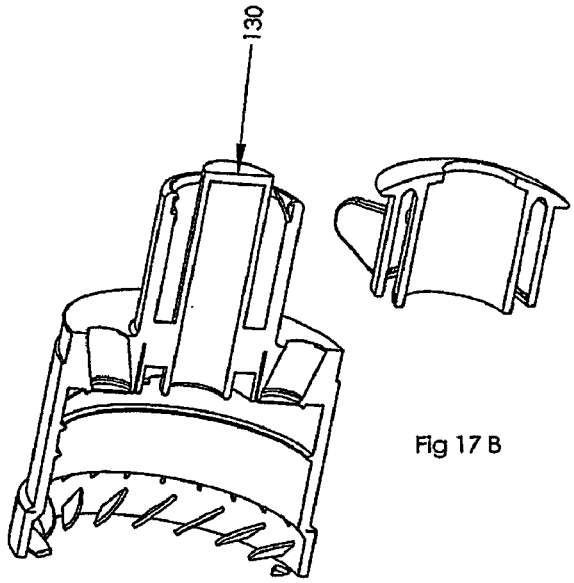

FIG. 14 illustrates a seventh embodiment of the invention which is a variant of the embodiment shown in FIG. 13. FIG. 14A is a view of the closure body from below, 14D is a view of the upper part of the closure body from below, and this part is provided with a gasket surface while the lower part has grooves for sealing.

FIG. 14E is a view of the lower part of the closure body from above. FIG. 14H is a detail from FIG. 14G illustrating grooves for locking the upper part of the closure body to the lower part. In this embodiment all the axes A1, B1, C1 are parallel. The closure device requires rotation of the parts 50 (upper part) and 10 (lower part) relative to one another. In this embodiment the drinking spout will be connected to the contents of the bottle by turning the upper part relative to the lower part.

FIG. 15 illustrates a drinking spout or rotatable part 31 which is a part of a drinking mechanism 30 and was shown in some of the previously described embodiments of the invention. FIG. 15A is a section of the rotatable part, depicting a protrusion 100 which permits the rotatable part to be easily turned. FIG. 15F shows a detail of FIG. 15B. A special variant or an eighth embodiment of the invention, utilising a rotating movement of a rotatable part of the type described and illustrated, for example, in FIGS. 1-3, 7-10 and 12-13 is an embodiment where additives do not necessarily have to be dispensed. As illustrated in the above-mentioned figures, the device comprises a rotatable part 31, where the cavity is equipped with a through opening from the at least one cavity. This through opening is of approximately the same size as an aperture in the rotatable part, which can be rotated at least between a position where the aperture is located directly above the through opening to a position where the through opening is blocked/closed.

The rotatable part may also have several apertures and be equipped with means for holding the rotating part in an open of closed position, for example a patterned peripheral surface area. Furthermore, the rotating part may have several cavities and several positions for opening several openings simultaneously in order to provide greater flow of liquid through the through-opening or to enable the openings to be opened after one another to provide faster access to the drinking opening or also give access to cavities with additives. Many variants are possible.

FIG. 16 illustrates a cover 45 for protection of the closure device. FIG. 16D shows a rib/seal that has to be broken when the bottle is opened in order to avoid tampering.

Even though individual examples of the invention have been illustrated, several variants may be envisaged by a person skilled in the art.

Figures 18A, 18B, 18C, 18D, 18E, 18F, 18G, 18H, 18I:
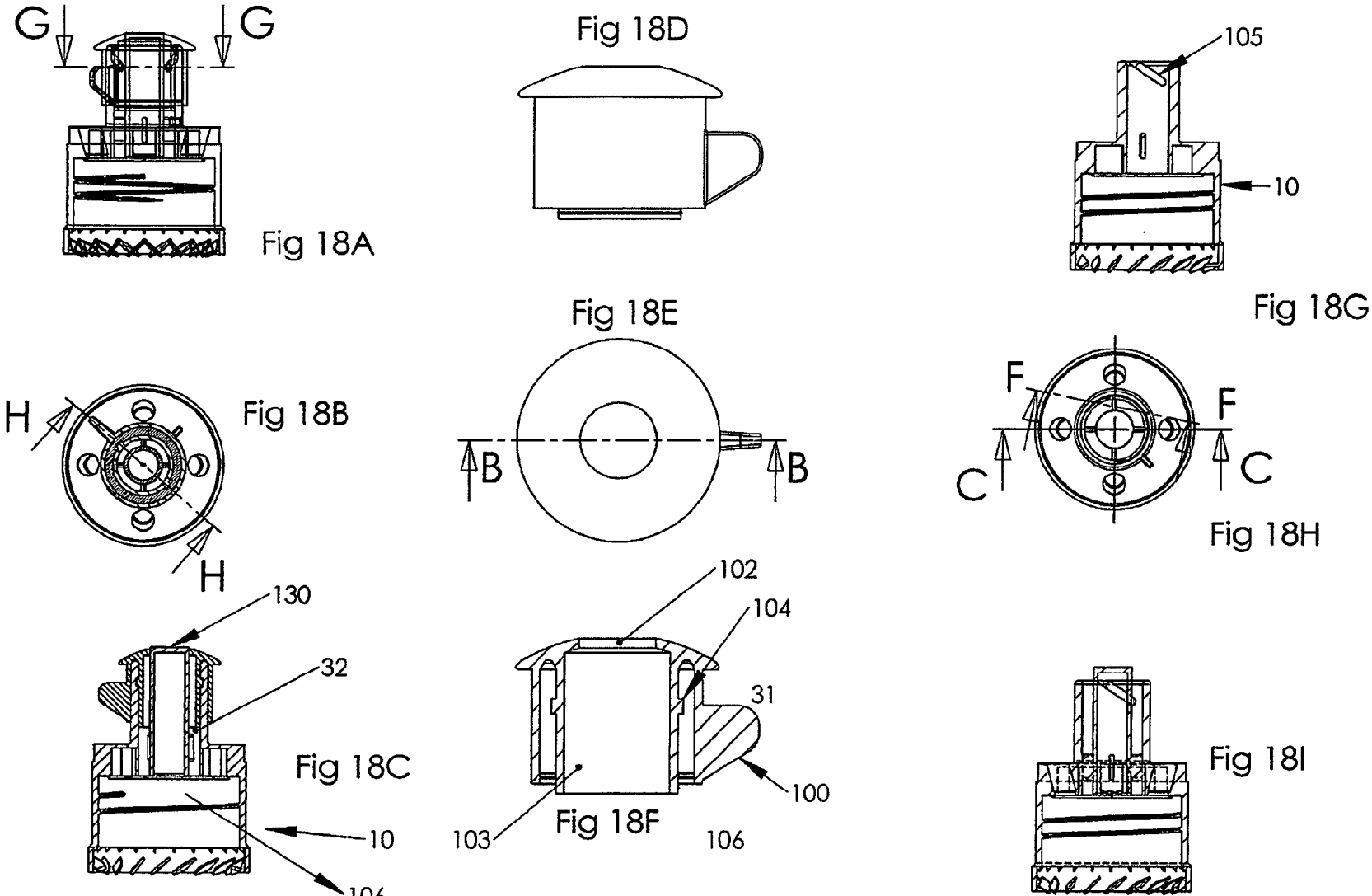
Figure 20A:
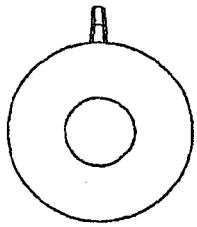
Figure 20D:
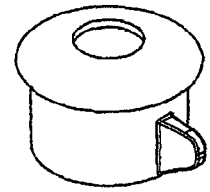
Figure 20B:
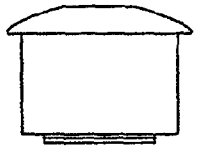
Figure 20E:
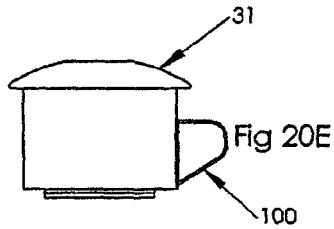
Figure 20C:
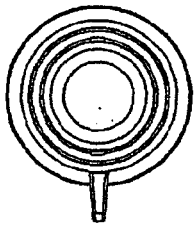
Figure 20F:
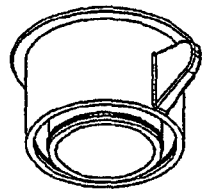

FIGS. 17-20 illustrate the embodiment of the drinking spout in greater detail. FIG. 18 shows that the rotatable part 31 comprises a protrusion 100 which permits the part 31 to be easily turned. The part 31 further comprises a drinking opening 102 in fluid connection with a cavity 103. The cavity 103 is connected with the cavities 120 in the drinking mechanism 30.

A control protrusion 104 is arranged to slide in a groove 105 (FIG. 19B) in the drinking mechanism 30, with the result that on rotation of part 31, part 31 is pulled up and away from the closure body 10.

FIG. 19A is a view of the closure body from below with cavities 2 and 120. FIG. 19C is a view of the closure body from below with protective cap 145 to prevent tampering.

FIG. 20 illustrates the rotatable part 31.

Even though specific combinations of features of the invention have been depicted in the illustrated embodiments, it will be obvious to a person skilled in the art that other combinations are also possible. For example, as regards the angle between the axis B1 for the cavities and the vertical axis A1 for the closure body, this could be 0 degrees (as illustrated for example in FIG. 14), 90 degrees (as illustrated for example in FIG. 6A) or it could have a value between these values (as illustrated for example in FIG. 6C). It is also possible to envisage an embodiment without a drinking spout (as illustrated in FIG. 5) where the plungers are arranged horizontally (as illustrated for example in FIG. 7). The plungers may for example be independent of one another (for example FIG. 5) or partly interconnected by means of a ring (for example FIG. 6A) or integrated in the ring (for example FIG. 6C). These variants may of course be combined with different mechanisms for definition and connection of cavities (hollow plungers, FIG. 6C, plungers that cut a membrane, FIG. 1B, blister solution FIG. 11B).

Thus the invention will provide a simple and flexible solution for supplying drinks with different flavours with a distinct reduction in stocks of drinks compared with the prior art.

The invention claimed is:

1. A closure device for a receptacle, arranged to be attached to the receptacle, the device comprising at least one first cavity for additive, and at least one second cavity, where the at least one first cavity and the at least one second cavity can be opened individually by respective opening mechanisms therefor which are integrated in the device and can be influenced from outside of the device, the opening mechanism for the at least one first cavity comprising a plunger part with one or more plungers, wherein each plunger can be influenced individually, the plunger part comprising a ring and the one or more plungers projecting downwards from the ring into the at least one first cavity, wherein the ring is made of at least one of a flexible and an elastic material and is corrugated with alternating raised portions and depressions, and the one or more plungers project down from the raised portions of the ring and are integral with the ring.

2. The closure device of claim 1, wherein the at least one second cavity is intended for access to a beverage.

3. The closure device of claim 1, wherein in the one or more plungers there is provided at least one cavity constituting one of the first and second cavities.

4. The closure device of claim 1, including a storage part with at least one cavity.

5. The closure device of claim 1, including a drinking mechanism connected to the at least one second cavity.

6. The closure device of claim 5, wherein the drinking mechanism includes a rotatable part.

7. The closure device of claim 1, wherein the additive is one of a flavour additive, a vitamin additive, effervescing powder, and a medicine.

8. The closure device of claim 1, wherein the additive is one of a fluid, a powder and a solid body.

9. The closure device of claim 1, comprising a plurality of plungers projecting downwardly from the raised portions of the ring.

* * * * *